United States Patent [19]

Tracy

[11] Patent Number: 4,870,761

[45] Date of Patent: Oct. 3, 1989

[54] SHOE CONSTRUCTION AND CLOSURE COMPONENTS THEREOF

[76] Inventor: Richard J. Tracy, 1002 Forest Dr., Elgin, Ill. 60120

[21] Appl. No.: 165,768

[22] Filed: Mar. 9, 1988

[51] Int. Cl.[4] ..... A43C 11/22; A43C 1/02; A43C 1/04; A43C 1/06

[52] U.S. Cl. ..... 36/51; 24/712; 24/712.2; 24/714.6; 24/715.3

[58] Field of Search ..... 36/50, 51, 58.5; 24/140, 143 R, 143 A

[56] References Cited

U.S. PATENT DOCUMENTS

| | | | |
|---|---|---|---|
| 181,948 | 9/1876 | Kleinschuster | 24/140 |
| 440,806 | 11/1890 | Griffen | 24/140 |
| 460,743 | 10/1891 | Dickson, Jr. | 24/140 |
| 640,755 | 1/1900 | Donavan | 36/50 X |
| 795,119 | 7/1905 | Harlow | 24/140 |
| 1,807,792 | 6/1931 | Miller et al. | 36/58.5 |
| 2,749,629 | 6/1956 | Scala | 36/58.5 |

FOREIGN PATENT DOCUMENTS

| | | | |
|---|---|---|---|
| 1001843 | 12/1976 | Canada | 36/50 |
| 107182 | 10/1924 | Switzerland | 24/140 |
| 355048 | 8/1931 | United Kingdom | 24/143 R |
| 596562 | 1/1948 | United Kingdom | 24/143 R |

*Primary Examiner*—James K. Chi

[57] ABSTRACT

The shoe construction generally includes a closure component having a set of interleaved, opposed stretchable fingers, and a stretchable cord securing the ends of the fingers together. The fingers are composed of stretchable material to grip the foot in a yieldable manner. Such a shoe construction and closure component is comfortable, due to the stretchable cord and fingers which expand during walking or running. Moreover, the resilient and stretchable closure component of the present invention, at the same time, aslo fits snugly against the upper contours of the foot to provide a new form of comfortable support. At the same time, in some forms of the novel construction of the present invention, it can be slipped on or off the foot, without undoing, or otherwise altering the closure component.

19 Claims, 3 Drawing Sheets

SHOE CONSTRUCTION AND CLOSURE COMPONENTS THEREOF

DESCRIPTION

1. Technical Field

The present invention relates in general to a shoe construction, and a closure component thereof. It relates more particularly to a shoe construction and a closure component thereof, which provide a wearer with greater comfort and support.

2. Background Art

The footwear of the general type with which the present invention is concerned, is a sport or recreational shoe, such as a walking, tennis, basketball or the like shoe. Various shoe constructions have been propounded to provide ease and comfort to the wearer during use. In this regard, there have been various different types and kinds of closure components, which have been provided to aid in the comfort and support of the wearer. For instance, references may be made to U.S. Pat. Nos. 697,590; 1,745,654; 3,169,325; and 3,931,686.

The disclosed laced closure components or structures generally require an upper of the shoe construction to be drawn together at a series of eyelets, by lacing a cord therethrough. The cord can cause the pressure of the closure to be concentrated at relatively small areas of the foot, in that conventional lacing systems are threaded in predominately serpentine/overlying pattern. This method of lacing is un-yielding due to the frictional interference of the laces which overlie each other when threaded. Further, unless each opposing eyelet pair is individually adjusted, balance of forces along the lacing path is un-attainable. Thus, significant discomfort to the wearer is realized.

Another concern associated with the use of the conventional laced shoe construction, is the inability of physically impaired or handicapped persons, as well as children and elderly persons, to tension the lace or cord properly by tying a knot in the cord. Also, spreading the upper or closure, sufficiently, to enable convenient slipping of the shoe on and off of the foot, can be difficult or otherwise inconvenient for the young or handicapped.

Therefore, there is a need for a shoe construction which is comfortable to wear, provides a high degree of support, is readily adjusted without requiring the ty ing of a knot or bow, and can be slipped on or off in a relatively expedient and comfortable manner.

Numerous solutions have been attempted to overcome the foregoing concerns presented by the conventional laced shoe constructions. For instance, in order to aid in wearing comfort and of slipping a shoe on and off the foot, there is disclosed in U.S. Pat. Nos. 2,824,351; 3,112,545; 3,855,715; 4,079,527; and 4,486,965 shoe constructions utilizing fastening devices such as zippers or Velcro-type straps. However, such attempts have proven to be less than entirely satisfactory for some applications, in that the proposed shoe constructions lack the degrees of ease, comfort and support necessary for some contemporary applications.

While some of these conventional shoe constructions have relieved partially, discomfort to the wearer, by providing elastic closure structures, they have sacrificed support for the foot. In this respect, prior known elastic closure components did not provide adequate support, which is particularly important in an athletic shoe, or in a walking shoe. The inadequate support has been due to the inherent weakness of the conventional elastic materials. Further, the conventional elastic materials rapidly deteriorate even in areas of moderate stress, i.e. waistbands of slacks, skirts, stockings, etc. The deterioration is evidenced by the loss of their ability to recover to their un-stressed position, thereby loosing the very properties which prompted their usage in the first place. This inability to recover to the un-stressed position reduces or eliminates what little support was gained in the first place.

Thus, it would be highly desirable to have a new and improved shoe construction which is not only comfortable to wear, but also is convenient and expedient to slip on or to remove from the foot. The shoe construction should provide adequate support which is maintainable over the useful life of the shoe, and have an aesthetically pleasing appearance. Such a construction should be readily modified to accommodate either men's or women's shoe styles. The shoe construction should be usable as a formal dress shoe, as well as an athletic footwear. The shoe construction should accommodate variations in foot sizes falling between standard sizes.

DISCLOSURE OF INVENTION

Therefore, it is an object of the present invention to provide a new and improved shoe construction and closure component, which aid in wearing comfort, and yet provides adequate support for the wearer.

It is another object of the present invention to provide such a new and improved shoe construction and a closure component, which enable the shoe construction to be slipped onto and off of the wearer's foot in a convenient manner.

Briefly, the above and further objects and features of the present invention are realized by providing a new and improved shoe construction and a closure component, which provides comfort and ease of access to the wearer, and which provides adequate support.

The shoe construction generally includes a closure component having a set of interleaved, opposed stretchable fingers, and a stretchable cord securing the ends of the fingers together. The fingers are composed of stretchable material to grip the foot in a yieldable manner.

Such a shoe construction and closure component is comfortable, due to the stretchable cord and fingers which expand during walking or running. Moreover, the resilient and stretchable closure component of the present invention, at the same time, also fits snugly against the upper contours of the foot to provide a new form of comfortable support. At the same time, in some forms of the novel construction of the present invention, it can be slipped on or off the foot, without undoing, or otherwise altering the closure component.

BRIEF DESCRIPTION OF DRAWINGS

The above mentioned and other objects and features of this invention and the manner of attaining them will become apparent, and the invention itself will be best understood by reference to the following description of the embodiments of the invention in conjunction with the accompanying drawings, wherein.

BEST MODE FOR CARRYING OUT THE INVENTION

Figure 1:
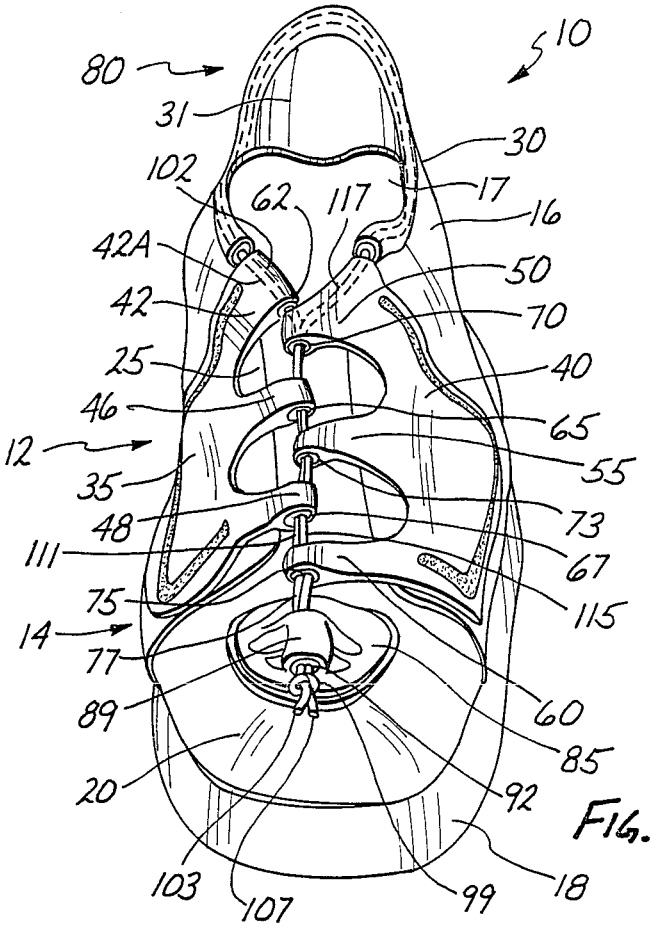
FIG. 1 is a pictorial view of a shoe construction, which is constructed in accordance with the present invention, illustrating the front and top portions thereof, and showing a laced closure component or structure which forms a part of the shoe construction and which is also constructed according to the present invention.
Figure 2:
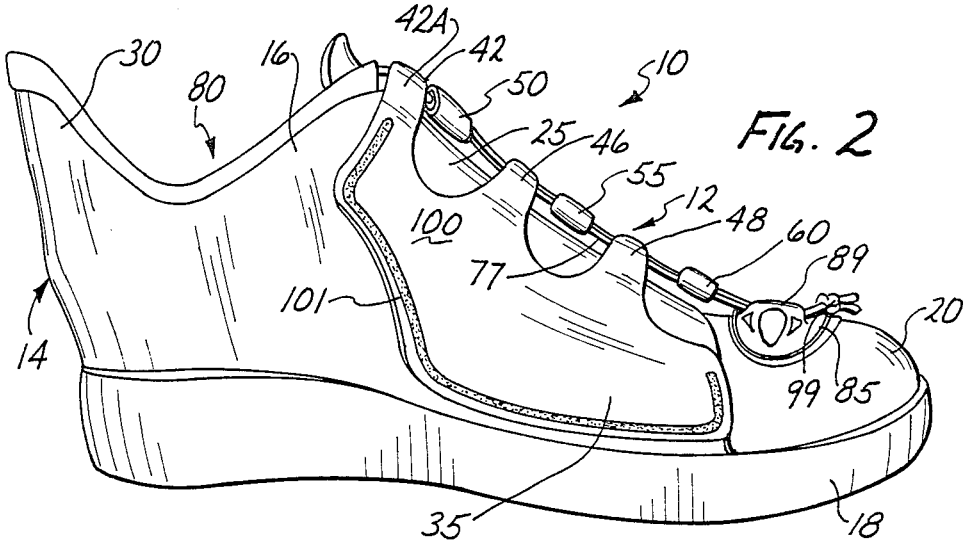
FIG. 2 is a right side elevational view of the shoe construction of FIG. 1.

Referring now to the drawings, and more particularly to FIGS. 1 and 2 thereof, there is illustrated a shoe construction 10, which is constructed according to the present invention, and which includes a closure component or structure 12, which is also constructed in accordance with the present invention. The illustrated and described shoe construction 10 is in the form of an athletic or walking shoe. However, it will become apparent to those skilled in the art, that the shoe construction of the present invention can have various different styles for both men and women, including dress shoe styles.

The shoe construction 10 generally comprises a hollow elongated foot-receiving body 14, having an upper 16 secured at its marginal edges, in a conventional manner to a sole 18, by techniques such as by sewing. The front portion of the sole 18 cooperates with the adjacent front portion of the upper 16 to form a toe section, generally indicated at 20. The upper 16 includes an opened front portion 25 which generally overlies the tarsal and the metatarsal parts of the wearer's foot (not shown) when positioned within the body 14. An inner tongue 17 cushions the foot, and underlies the front opened portion 25 to cover it over.

The upper 16 further includes an opened top portion 30, being adapted to engage the lower part of the wearer's leg (not shown), and having a foot access opening 31 (FIG. 1). In order to provide the shoe construction 10 with a comfortable fit, as well as a stylish, aesthetically pleasing appearance, the closure component 12 is fastened to the opposite sides of the opened front portion 25 to secure the opposite sides together about the upper portion of the foot.

The closure component 12 generally comprises a pair of oppositely disposed side panels 35 and 40, which are composed of a suitable and stretchable elastomeric material, so as to provide resilience to the upper portion of the shoe construction 10, for giving increased comfort, as well as support, to the wearer's foot. In this manner, the shoe construction 10 confines the foot snugly, and yet flexes yieldingly during walking or other activities.

The side panel 35 includes a plurality of spaced-apart transversely-extending elongated fingers 42, 46 and 48, which are interleved with a plurality of corresponding generally similar elongated spaced-apart transversely-extending fingers 50, 55 and 60 of the side panel 40. The fingers 42, 46, 48, 50, 55 and 60 include a plurality of eyelets 62, 65, 67, 70, 73 and 75 respectively, for receiving a stretchable lace or cord 77, which will hereinafter be described in greater detail, is an extruded central stretch member, of a non-circular cross-section throughout its length. The non-circular cross-section of the cord enables friction to be reduced, as the central stretch member passes through the relatively in-line passageways formed by the eyelets. This allows the system to reach an equilibrium, i.e. a relatively balanced state of tension along the adjustment path which reduces or eliminates pressure points commonly associated with conventional lace type shoes.

The use of the hollow stretch member, which can be extruded, is very flexible and highly abrasion resistant. Thus, unlike conventional fabric covered elastic materials which tend to abrade, the inventive stretch member remains resilient over a much longer period of time, if not indefinitely.

The closure component 12 further includes an elongated hem portion 80, which extends along and is secured to, substantially the entire periphery of the opened top portion 30. The portion 80 is of a U-shaped configuration, and cooperates with the tongue 17 to complete the top access opening 31. The hem portion 80 is made of suitable stretchable elastomeric material, in order to provide resilience to the shoe construction 10, thereby providing increased comfort to the wearer. The flexible composition of the hem portion 80, the fingers and the cord 77, enables the stretching of and thus enlarging the opened top portion 30 and the front opened portion 25, for permitting the insertion of the foot inside the foot-receiving body 14 initially through the top opening 3 and down into the body portion.

Thus, the hem portion 80, helps obviate substantially the general concerns associated with the lacing and unlacing of the shoe construction. Additionally, the stretchable composition of the hem portion 80 enables the shoe construction 10 to accommodate various sizes of feet, as well as variations in the sizes of the foot during use, while still maintaining a snug yet comfortable fit.

The closure component 12 further includes a relatively small, substantially flat flexible panel or patch 85, which is secured to the upper surface of the toe portion 20, and which serves as a locking device for the central stretch member or cord 77. The panel 85 includes a raised eyelet section or portion 89, which is hollow throughout its axial length for defining an eyelet 92, and which receive partially the knotted ends of the loop of the cord 77.

The cord 77 is made of stretchable elastomeric material, and interconnects and draws together the panel 85, the spaced-apart side panels 35 and 40, and the hem portion 80, similar to a draw string closure. In this regard, the ends of the cord 77 are tied together in a knot at 99, and are positioned forwardly of the eyelet section 89 of the panel or patch 85. The cord 77 is threaded through the hem 80, exits the hem, and extends together in a doubled over manner substantially rectilinearly side-by-side through the eyelets in the distal ends of the fingers and the eyelet 89 to the knot 99, which is properly secured to tension the cord 77.

The ends of the cord 77 terminate in a knot 99. However, other methods and devices can be used to prevent the cord 77 from becoming untied, and from causing the shoe construction 10 to become unlaced.

In operation, the wearer simply stretches the hem portion 80, and slides his or her foot inside the interior of the foot-receiving body 14 without untying or removing the cord 77. In order to remove the shoe construction 10, the wearer simply stretches the hem portion 80, and slips his or her foot out of the foot receiving body 14, without untying the cord 77. Therefore, the shoe construction can be placed on, or taken off the foot, without unlacing the shoe construction.

During use, the closure structure 12 deforms and yields to accommodate the tensions on the tarsal and metatarsal portions of the foot. In this regard, each one of the fingers 42, 46, 48, 50, 55 and 60 stretches or deforms independently, in response to expansion and contraction of the foot. Also, the cord 77 can stretch or deform linearly. For instance, the finger 42 can stretch proportionally to the tension exerted on it by the foot during walking or running. At the same time, the finger 50 stretches proportionally to the tension exerted on it, independently of the stretching of the finger 42 and from the remaining fingers of the closure structure 12. Thus, as the weight of the body of the wearer shifts during waking and running, different parts of the foot exert different pressures on the closure component, which yields to varying degrees to the amount and location of the stress applied by the foot. The result is a snug support for the foot, and yet a comfortable feel to the wearer.

Considering now the closure component 12 in greater detail with respect to FIGS. 1, the opposed side panels 35 and 40 are substantially similar in design and construction, and therefore, only the panel 35 will now be described hereinafter in greater detail. The side panel 35 includes an elongated contoured surface 100, which is secured fixedly along its lower peripheral edge to the upper 16 by a suitable technique, such as by stitching at 101. The surface 100 has a stretchable composition, and is integrally connected to the spaced-apart fingers 42, 46 and 48 extending transversely therefrom.

Figure 3:
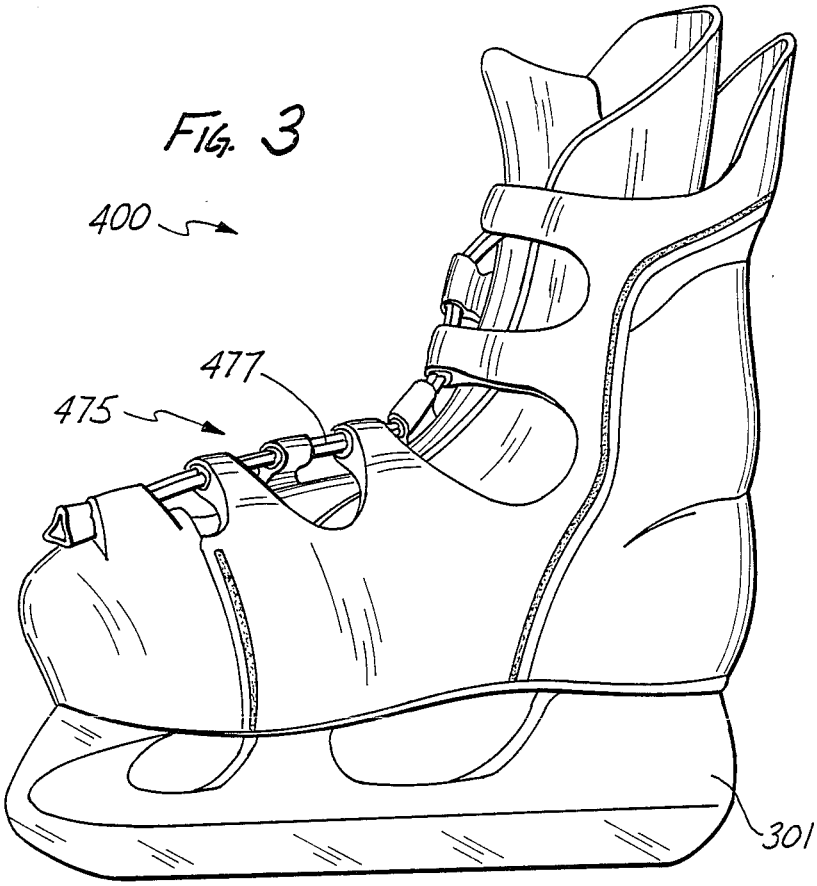
FIG. 3 is a left side elevational view of a further shoe construction and closure component, which are constructed in accordance with the present invention.

The fingers 42, 46 and 48 are generally similar to one another, in structure and composition, and therefore only the finger 42 will now be described hereinafter in greater detail. As illustrated in FIGS. 1 and 3, the finger 42 includes a stretchable substantially flat strip 42A, terminating in a distal end portion 102, has the eyelet 62 extending therethrough, for receiving a single thickness of the cord 77. The remaining fingers have eyelets which receive double thicknesses of the cord.

While the fingers 42, 46, 48, 50, 55 and 60 are shown in FIG. 1 as having substantially equal thicknesses, in accordance with the present invention, the individual fingers can have different thicknesses for controlling the degree of elasticity and resilience thereof. For instance, it may be desirable for some applications to cause the upper fingers, such as the fingers 42, 46 and 50 to be less elastic than the remaining fingers, and thus the thickness of such upper fingers can be less than the thickness of the lower fingers.

In order to maintain a substantially uniform tension on the upper portion of the foot and graduating progressively from the upper to the lower fingers, the respective thicknesses of the fingers 42, 46, 48, 50, 55 and 60 can be designed to decrease incremental and progressively from the uppermost finger 42 toward the lowermost finger 60. In this regard, the thickness of the upper finger 42, is greater than the adjacent finger 50, which in turn is thicker than the next adjacent lower finger 46, and so on.

Each persons foot is shaped somewhat differentialy and likewise, requires differing degrees of support in different places. Further, different activities i.e. ice skating, boating, tennis, football, running, walking, etc. require different types of support to different areas of the foot. With the fingers of the present invention, being resilient, and separately stress controllable by varying cross sectional mass, configuration, or both; there is provided a desired level of support or control in a specific desired region of the shoe.

Each one of the finger eyelets, such as the eyelet 73, is similar to the other finger eyelets. The eyelets extend through the edges thereof, and not through the face thereof. Thus, the fingers each are sufficiently thick to have its eyelet extend therethrough.

Considering now the hem portion 80 in greater detail with respect to FIG. 1 it has a generally elongated and tubular construction. The hem portion 80 includes an elongated inner opening or passage which extends throughout the entire length of the hem portion 80, for receiving the cord 77.

Considering now the cord 77 is greater detail with reference to FIG. 1, it has a pair of free ends 103 and 107 which extend a short distance beyond the raised eyelet section 89. The free ends 103 and 107 extend rearwardly and upwardly into rectilinear intermediate side-by-side portions 111 and 115 respectively. Such intermediate portions 111 and 115 extend adjacent to one another through the eyelet 92 of the raised section 89, as well as through the eyelets 65, 67, 70, 73 and 75 of the fingers 46, 48, 50, 55 and 60, respectively.

The intermediate portions 111 and 115 separate at the upper end of the eyelet 70 of the finger 50, and enter the opposite ends of the hem to form a closed loop. As indicated in FIG. 1, the intermediate portion 111 extends through the eyelet 62 of the finger 42, while the intermediate portion 115 extends through the eyelet 70 of the finger 50.

Considering now the shoe construction 400 in greater detail with respect to FIG. 3, it is constructed according to the invention, and is generally similar to the shoe construction of FIG. 1. The construction 400 is adapted for use as a skate by employing a blade on the underside of the outer sole of the shoe construction 400. The shoe construction 400 includes a closure component 475 having a cord 477, which is similar to the closure component and the cord of FIG. 1, in composition and construction, with the exception that the cord 477 is triangular in cross- section throughout its length.

Figure 4:
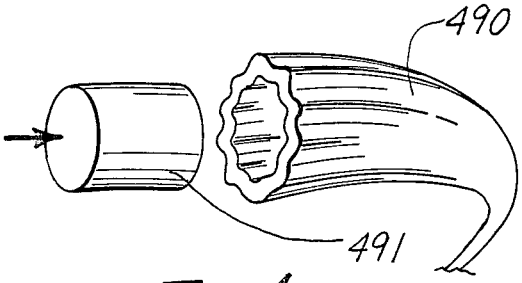
FIG. 4 is a fragmentary pictorial view of a lacing which may be used alternatively with one of the shoe constructions of the present invention.

FIG. 4 illustrates a cord 490, which is constructed according to the present invention, and which can be used as a part of the shoe construction 400 of FIG. 3, instead of the cord 477. The cord 490 has a similar composition and construction as the cord 477, with the exception that the cord 490 has a corrugated cross-sectional configuration.

Also, a plug 491 is force fitted into the interior of one of the ends of the cord 490. A similar plug (not shown) is force fitted into the opposite open end. Thus, the cord ends are enlarged to retain them in place, without the need for a knot.

Figure 5:
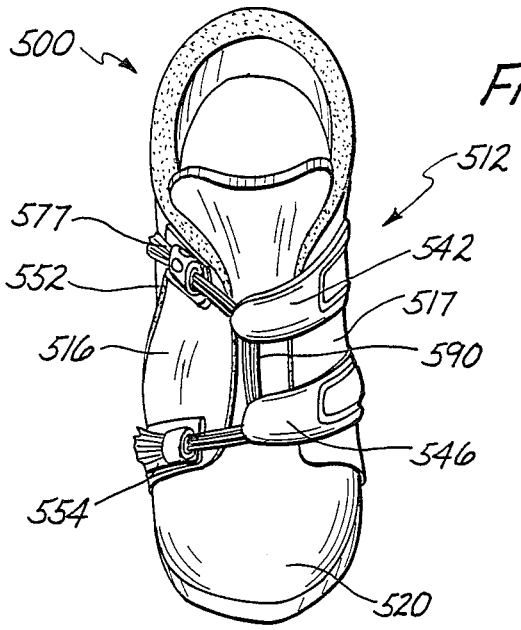
FIG. 5 is a front and top pictorial view of another shoe construction and closure component, which are constructed in accordance with the present invention.
Figure 6:
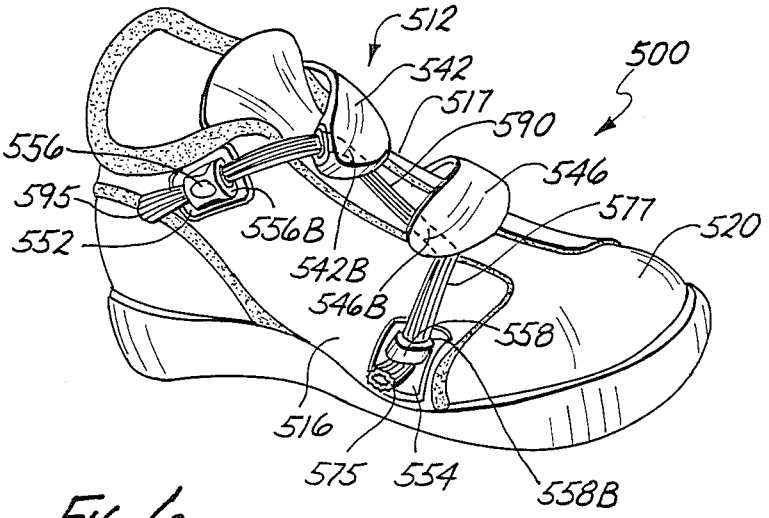
FIG. 6 is a front and right side pictorial view of the shoe construction of FIG. 5.

Considering now the shoe construction 500 in greater detail with respect to FIGS. 5 through 6, it generally includes a closure component 512, which is similar to the closure components of FIG. 1, except that the component 512 and 517 do not have interleaved fingers. The closure structure 512 includes a cord 577 and a pair of spaced- apart elongated fingers 542 and 546, which are similar to the fingers 46 and 48 of the shoe construction 10 of FIG. 1. Each of the fingers 542 and 546 extends from one side panel 5, for attachment to the upper 516.

The finger 542 includes an eyelet 542B (FIG. 6) that is disposed at the distal end thereof, for receiving the cord 577. Similarly, the finger 546 includes an eyelet 546B for receiving the same cord 577. The closure structures 512 517 further includes a pair of spaced-apart side locking panels or patches 552 and 554, which are similar to the front locking panel 85 of the shoe construction 10 of FIG. 1, with the exception that the side panels 552 and 554 are secured to the right side of the upper 516 of the shoe construction 500, rather than to its toe portion 520.

The side panel 552 has a raised portion 556, which is similar to the raised portion 85 of the shoe construction 10 of FIG. 1. Similarly, the side panel 554 has a raised portion 558, which is also similar to the raised portion 85.

The cord 577 is similar in construction and composition to the cord 477 of the shoe construction 400 of FIG. 3, and interconnects the side panels 552 and 554 to the fingers 542 and 546. The arrangement of the closure structure 512 therefore requires only a single length of cord 577. In this regard, the cord 577 includes a first free end 575, that passes through the eyelet 558B of the raised portion 558. A plug (not shown) similar to the plug of FIG. 4, is fitted within the free end 575 for preventing it from slipping through the eyelet 558B.

The free end 575 extends into an intermediate portion 590, which extends through the eyelets 546B and 542B of the fingers 546 and 542 respectively. The intermediate section 590 then terminates in a second free end 595, which extends through the eyelet 556B of the raised section 566. Another plug (not shown), similar to the plug of FIG. 4, is fitted within the free end 595, for preventing it from slipping through the eyelet 556B of the raised section 556.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A shoe construction, comprising:

a foot receiving body portion having means defining a front access opening;

a closure component having at least one transversely extending individual finger means disposed at least partially over said access opening;

cord means secured between said finger means and the body portion; and said finger means and said cord means being composed of stretchable material to stretch in opposition to one another to permit the foot to enter the shoe and to snap back resiliently to a closed position to enable said closure to confine yieldingly the foot of the user;

said finger means including eyelet means receiving an intermediate portion of said cord means threaded therethrough;

means for attaching adjustably the end portions of said cord means to said body portion to enable said cord means to be tensioned adjustably in opposition to said finger means.

2. A shoe construction according to claim 1, wherein said finger means are configured and arranged in a pair of first and second sets of oppositely opposed, spaced-apart individual ones of said finger means, said first and second sets being interleaved transversely.

3. A shoe construction according to claim 2, wherein said cord means interconnects the distal ends of the first and second sets of interleaved finger means.

4. A shoe construction according to claim 3, further including a U-shaped hem means connected to the body portion for receiving a rear portion of said cord means for at least partially surrounding an upper portion of the access opening.

5. A shoe construction according to claim 4, wherein said hem means is composed of stretchable material.

6. A shoe construction according to claim 4, wherein said cord means includes a cord arranged in a loop, and the cord extends through said hem means and from said hem means in a parallel, side-by-side rectilinear configuration to connect to the distal ends of said finger means.

7. A shoe construction according to claim 6, wherein said cord means includes end portions, and means securing said ends to the body portion.

8. A shoe construction according to claim 6, wherein said cord ends are knotted together.

9. A shoe construction according to claim 7, wherein said cord is hollow and has opened ends, and further including plug means inserted into said open ends for facilitating the securement thereof to the body portion.

10. A shoe construction according to claim 9, further including eyelet means connecting the cord ends to the body portion.

11. A shoe construction according to claim 1, wherein said finger means includes eyelets at the distal ends thereof for receiving said cord means, said eyelets defining cord means receiving passages extending through the side edges of said finger means.

12. A shoe construction according to claim 1, further including blade means fixed to the underside of the body portion to enable the shoe construction to serve as an ice skate.

13. In a shoe construction having a foot receiving body portion including a foot access opening, an arrangement comprising:

a closure component having at least one transversely extending individual finger means disposed at least partially over said access opening;

elongated cord means secured between said finger means and the body portion; and said finger means and said cord means being composed of resilient material to stretch in opposition to one another to permit the foot to enter the foot receiving portion and then to retract resiliently to a closed position to enable said closure to confine yieldingly the foot of the user;

said finger means including eyelet means receiving an intermediate portion of said cord means threaded therethrough;

means for attaching adjustably the end portions of said cord means to said body portion to enable said cord means to be tensioned adjustably in opposition to said finger means.

14. An arrangement according to claim 13, wherein both said finger means and said cord means are composed of stretchable material.

15. An arrangement according to claim 13, wherein said finger means are configured and arranged in a pair of first and second sets of oppositely opposed, spaced-apart individual ones of said finger means, said first and second sets being interleaved transversely.

16. An arrangement according to claim 15, wherein said cord means interconnects the distal ends of the first and second sets of interleaved finger means.

17. An arrangement according to claim 16, further including a U-shaped hem means connected to the body portion for receiving a rear portion of said cord means for at least partially surrounding an upper portion of the access opening.

18. An arrangement according to claim 17, wherein said hem means is composed of stretchable material.

19. An arrangement according to claim 18, wherein said cord means includes a cord arranged in a loop, and the cord extends through said hem means and from said hem means in a parallel, side-by-side rectilinear configuration to connect to the distal ends of said finger means.

* * * * *

UNITED STATES PATENT AND TRADEMARK OFFICE

CERTIFICATE OF CORRECTION

PATENT NO. : 4,870,761

DATED : October 3, 1989

INVENTOR(S) : Richard J. Tracy

It is certified that error appears in the above-identified patent and that said Letters Patent is hereby corrected as shown below:

Title page:

In the abstract: line 10, after "at the same time", delete "aslo", and substitute therefor --also--.

Column 5, line 65, delete "differentialy" and substitute therefor --differently--.

Column 6, line 18, after "77", delete "is" and substitute therefor --in--.

Column 7, line 25, after "(not shown)", insert --,--.

Signed and Sealed this

Ninth Day of April, 1991

*Attest:*

HARRY F. MANBECK, JR.

*Attesting Officer*

*Commissioner of Patents and Trademarks*